US006997729B2

(12) United States Patent
Sunaga

(10) Patent No.: US 6,997,729 B2
(45) Date of Patent: Feb. 14, 2006

(54) ELECTRICAL CONNECTOR FOR FLAT CABLE

(75) Inventor: Shiro Sunaga, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 11/185,833

(22) Filed: Jul. 21, 2005

(65) Prior Publication Data

US 2005/0255732 A1 Nov. 17, 2005

(30) Foreign Application Priority Data

Mar. 8, 2004 (JP) ..... 2004-226839

(51) Int. Cl.
*H01R 13/62* (2006.01)

(52) U.S. Cl. ..... 439/260

(58) Field of Classification Search ..... 439/260–261, 439/495, 492, 630, 341, 67, 267
See application file for complete search history.

(56) References Cited

U.S. PATENT DOCUMENTS 2,811,700 A * 10/1957 Kuch ..... 439/59
3,475,717 A * 10/1969 Lane ..... 439/260
6,056,572 A * 5/2000 Matsumoto et al. ..... 439/260
2002/0106924 A1 * 8/2002 Uehara ..... 439/260
2002/0115326 A1 * 8/2002 Yamane ..... 439/260
2003/0060072 A1 * 3/2003 Miura ..... 439/260
2004/0171293 A1 * 9/2004 Tsunematsu ..... 439/260
2005/0026487 A1 * 2/2005 Yu ..... 439/260

FOREIGN PATENT DOCUMENTS

JP 2002-93504 3/2002

* cited by examiner

*Primary Examiner*—Jean F. Duverne
(74) *Attorney, Agent, or Firm*—Takeuchi & Kubotera, LLP

(57) ABSTRACT

Each terminal (8) includes an upper arm portion (9), a middle arm portion (10), and a lower arm portion (11). A cam portion of the pressing portion member is supported and guided between the upper arm portion and the middle arm portion, so that the pressing portion member is movable between an open position and a closed position. A flat cable C is inserted between the middle arm portion and the lower arm portion. When the pressing portion member moves, the middle arm portion is pushed, so that the flat cable and a connecting portion of the middle arm portion are pressed and contacted. The lower arm portion (11) has a held portion (11A) at a base portion thereof to be held with a housing. A flexible portion (13) is formed at a base portion of the upper arm portion extending upwardly from the base portion of the lower arm portion. When the pressing portion member moves to a closed position, the middle arm portion and the upper arm portion have elasticity capable of degenerating integral deformation around the flexible portion (13) as well as deformation in a separating direction from each other relatively.

20 Claims, 5 Drawing Sheets

ELECTRICAL CONNECTOR FOR FLAT CABLE

TECHNICAL FIELD

The present invention relates to an electrical connector for a flat cable.

BACKGROUND TECHNOLOGY

Patent Reference 1 has disclosed an electrical connector as such a type of electrical connector. The connector disclosed in Patent reference 1 has terminals made of metal and having a flat over all shape, and plate surfaces of the terminals are arranged to be parallel to each other. Each of the terminals is provided with a fixing portion; an upper beam; a middle beam; and a lower beam, each having an arm shape and extending from the fixing portion in parallel in a same direction.

The fixing portion is inserted into a corresponding hole in a housing to be fixed thereto. The fixing portion supports a cam portion with an oval shape disposed on an actuator as a pressing portion member between the upper beam and the middle beam to be rotatable. A flexible wiring board, i.e., a type of flat cable, can be inserted into a space between the middle beam and the lower beam.

The upper beam has a high rigidity and is difficult to deform. The middle beam is easy to deform. In the connector disclosed in Patent Reference 1, after the flexible wiring board is inserted while the actuator is located at an open position, when the actuator is moved to a closed position, the cam portion of the actuator deforms the middle beam downwardly, so that an electrode portion of the middle beam elastically contacts with a corresponding circuit portion on an upper surface of the flexible wiring board.

[Patent Reference 1] Japanese Patent Publication No. 2002-93504

In the connector disclosed in Patent Reference 1, the upper beam has a high rigidity and is difficult to deform. Ideally, the upper beam is a rigid body. Elastic deformation for obtaining a contact pressure with the flexible wiring board relies only on the middle beam. That is, when the terminals as a whole are considered as a spring system, an elastic force, i.e., the contact pressure, is obtained through a single spring through deformation of the middle beams corresponding to a difference between a short diameter and a long diameter of the cam portion.

In Patent Reference 1, in order to obtain a deformation amount sufficient for obtaining the contact pressure, it is necessary to apply a large force to the middle beam as the single spring. That is, it is necessary to apply large force to the actuator. In other words, the terminals form a rigid spring system as a whole.

SUMMARY OF THE INVENTION

In view of the problems described above, an object of the present invention is to provide an electrical connector for a flat cable having a terminal in which it is possible to operate a pressing portion member with a small force under a flexible spring system, and to obtain a sufficient deformation amount even if a deformation of a cam portion of the pressing portion member corresponding to the actuator is the same.

According to the present invention, an electrical connector for a flat cable includes a plurality of metal terminals arranged in a housing such that plate surfaces thereof are parallel to each other. Each of the metal terminals includes an upper arm portion, a middle arm portion, and a lower arm portion each extending in a substantially same direction. A cam portion of the pressing portion member is supported and guided between the upper arm portion and the middle arm portion capable of elastically deforming in a plate surface, so that the pressing portion member is movable between an open position and a closed position. An insertion space for the flat cable is formed between the middle arm portion and the lower arm portion. At least one of the middle arm portion and the lower arm portion has a contact portion at an inner edge portion for contacting with a circuit portion of the flat cable. When the pressing portion member is located at the closed position, the flat cable can be inserted into the insertion space. When the pressing portion member is located at the open position, the pressing portion member pushes the middle arm portion to deform in the plate surface of the terminal, thereby press-contacting the flat cable with the contact portion.

In the electrical connector for the flat cable, according to the present invention, the lower arm portion is provided with a held portion held with the housing at a base portion thereof. A flexible portion is provided at a base portion of the upper arm portion extending upwardly from the base portion of the lower arm portion. When the pressing portion member moves to the closed position, the middle arm portion and the upper arm portion have elasticity capable of degenerating integral deformation around the flexible portion as well as deformation in a separating direction from each other relatively.

According to the present invention, the lower arm portion is provided with a held portion held with the housing in a range of a base portion thereof. An end portion of the base portion is provided with a connecting portion and a base portion of the upper arm portion extending upwardly from a portion between the held portion and the connecting portion. When the pressing portion member completely moves to the closed position, the middle arm portion receives a resistance force from the flat cable to elastically deform the upper arm portion. Accordingly, the flat cable is sandwiched between the upper arm portion and the lower arm portion through the pressing portion member and the middle arm portion.

In the present invention, when the terminal is considered as a spring system as a whole, a first stage spring is disposed at the flexible portion between an area including the upper arm portion and the middle arm portion and the held portion of the lower arm portion. In the area, the upper arm portion and the middle arm portion have their own springs in series as a second stage spring. Accordingly, the terminal as a whole has the spring in two stages, and the two springs are provided in series in the second stage, thereby forming a very soft spring system.

In the connector, after the flat cable is inserted, when the pressing portion member is moved to the closed position, the upper arm portion deforms upwardly and the middle arm portion deforms downwardly relatively. Additionally, the upper arm portion and the middle arm portion deform relative to the flexible portion. As a result, the middle arm portion deforms greatly, thereby obtaining a sufficient deformation at the flexible portion.

According to the present invention, when the middle arm portion has elasticity deforming easier than the upper arm portion, the middle arm portion easily deforms more than the upper arm portion does. It is preferable as the middle arm portion directly contacts with the flat cable. The middle arm portion may be formed, for example, to branch from the upper arm portion at a specific position away from the flexible portion. According to the present invention, the lower arm portion is attached to the housing through a corresponding slit of the housing. The held portion disposed at the base portion of the lower arm portion is held with the corresponding slit.

According to the present invention, at least one of the upper arm portion and the middle arm portion is provided with a regulating portion having at least one of a concave shape and a convex shape for regulating a cam shaft portion of the pressing portion member to move within a specific range. Accordingly, the cam shaft portion of the pressing portion member is prevented from shifting in a lateral direction when the pressing portion member moves between the open position and the closed position.

According to the present invention, in the middle arm portion, it is preferred that an area including the flexible portion and a portion supporting the cam shaft portion of the pressing portion member has rigidity greater than that of other areas of the middle arm portion. Accordingly, it is possible to securely transmit a force from the cam shaft portion to the flat cable while preventing deformation, especially flexural deformation, due to a force from the can shaft portion and a reactive force from the flat cable.

According to the present invention, the housing includes an abutting portion entering between the terminals from free ends thereof and abutting against the pressing portion member at a portion other than the cam shaft portion of the pressing portion member for guiding and regulating the pressing portion member when the pressing portion member moves between the open position and the closed position, thereby preventing shifting or deviating when the pressing portion member moves.

According to the present invention, the lower arm portion has a gap between a free end portion thereof and the housing to have elasticity. With the elasticity, even when the contact portion of the middle arm portion of the terminal or the cable supporting portion of the lower arm portion has a variance in a position among the terminals, it is possible to effectively absorb the variance.

According to the present invention, each of the terminals does not need to have all of the upper arm portion, the middle arm portion, and the lower arm portion. For example, two adjacent terminals are combined into a set, and the set of terminals may have the three arm portions.

That is, the terminals include a plurality of sets of a first terminal and a second terminal. The first terminal has the upper arm portion and the lower arm portion, and the second terminal has the middle arm portion and the lower arm portion, and is combined with the first terminal, thereby forming the three arm portions. The lower arm portion has the held portion to be held with the housing at the base portion thereof. The first terminal has the flexible portion at the base portion of the upper arm portion extending upwardly form the base portion of the lower arm portion. The second terminal has the flexible portion at the base portion of the middle arm portion extending upwardly from the base portion of the lower arm portion. When the pressing portion member moves to the closed position, the upper arm portion of the first terminal and the middle arm portion of the second terminal have elasticity capable of degenerating deformation around the flexible portion in a separating direction from each other relatively.

In each aspect of the present invention described above, the pressing portion member is opened upwardly near the cam shaft portion, and the opening preferably forms a space for allowing the upper arm portion of the terminal to deform upwardly, thereby preventing the connector from increasing a size thereof.

In the present invention, as described above, the flexible portion is provided between the base portion of the lower arm portion as the fixed side relative to the housing and the middle arm portion and the upper arm portion. The portion between the middle arm portion and the upper arm portion has elastic flexibility. Accordingly, the spring system of the terminals as a whole becomes soft. As a result, even though a shift of the cam shaft portion of the pressing portion member is the same, it is possible to operate the pressing portion member with a small force, and to secure sufficient deformation of the flexible portion.

BEST MODES FOR APPLYING THE INVENTION

Hereunder, embodiments of the present invention will be explained with reference to the accompanying drawings.

First Embodiment

Figure 1:
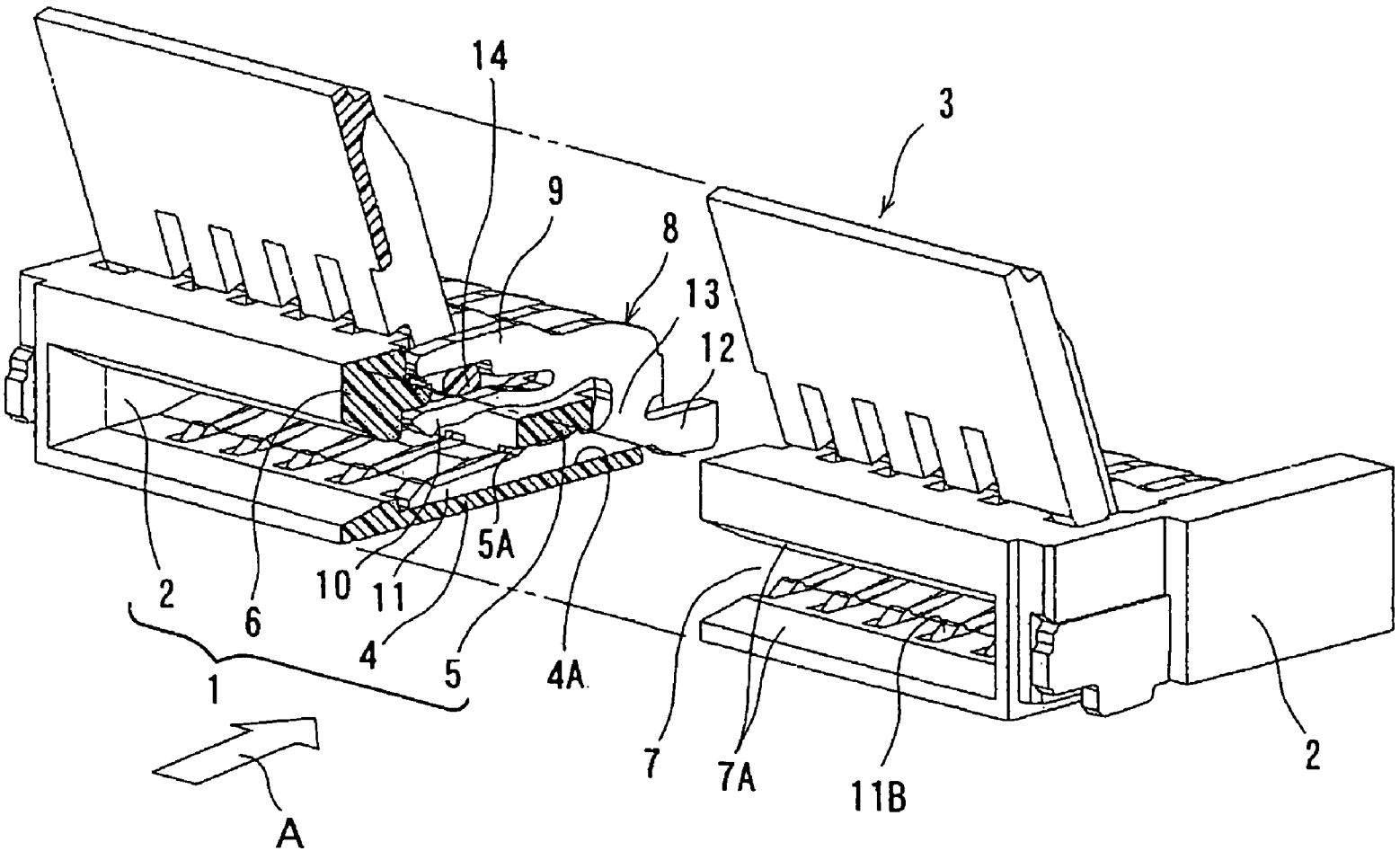
FIG. 1 is a partially sectional perspective view of the connector according to the first embodiment of the present invention showing the state that the pressing portion member is located at the open position.
Figure 2:
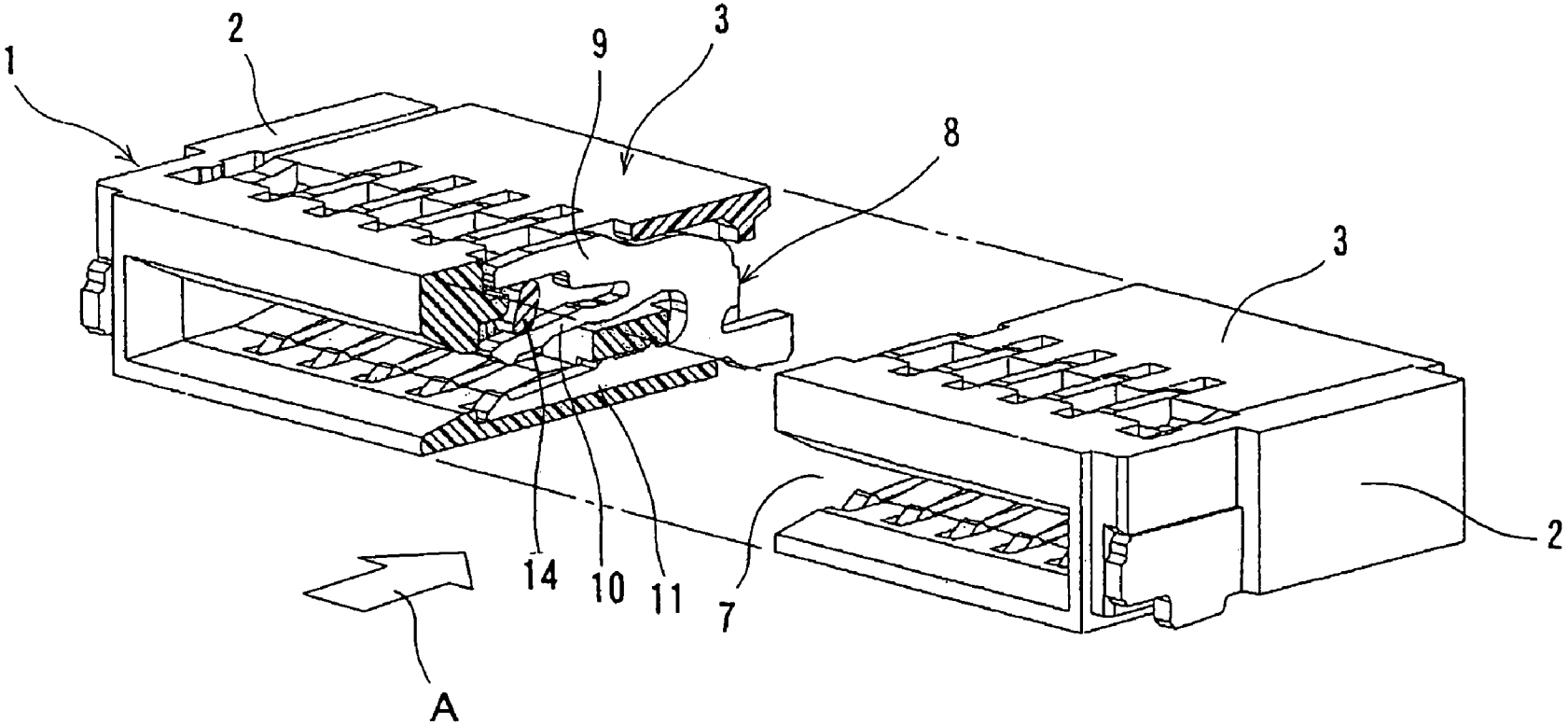
FIG. 2 is a partially sectional perspective view of the connector showing the state that the pressing portion member is located at the closed position.

FIG. 1 and FIG. 2 are partial sectional perspective views of a connector according to a first embodiment of the present invention. FIG. 1 shows a state that a pressing portion member is located at an open position, and FIG. 2 shows a state that the pressing portion member is located at a closed position. A flat cable to be inserted in an A direction is omitted in both of the figures.

In the figures, reference numeral 1 denotes a housing made of an electrically insulating material and having a shape with a wide width in the left-to-right direction (a direction perpendicular to the A direction viewed from above). Except sidewall portions 2 on left and right sides, a front upper portion is opened in the A direction. When the pressing portion member 3 is located at the closed position, the pressing portion member 3 is retained in the open space. When the pressing portion member 3 is located at the closed position, the connector as a whole has a cuboid shape as shown in FIG. 2.

The housing 1 includes a bottom wall portion 4, a middle wall portion 5, and an upper wall portion 6, all of which are connected with the sidewall portions 2. The bottom wall portion 4 forms a bottom surface for placing a circuit board (not shown), and extends over a whole rectangular shape of the housing 1. The middle wall portion 5 has a short length in the A direction, i.e., an insertion direction of the cable, and is situated at a middle in a height direction. The middle wall portion 5 is formed to protrude from the bottom wall portion 4, and is provided with slit grooves 5A for receiving lower arm portions (described later). The upper wall portion 6 is provided at a front edge in the A direction. The upper wall portion 6, the bottom wall portion 4, and the sidewall portions 2 constitute an insertion opening 7 for a flat cable. The insertion opening 7 has a tapered portion 7A for easily inserting the cable. The housing 1 protrudes beyond free ends of upper arm portions and middle arm portions, and is provided with an abutting portion 1A for regulating the pressing portion member 3 from deviating backward. The housing 1 has a cut portion corresponding to the upper arm portions and the middle arm portions at an arranging position of terminals 8.

The terminals 8 held with the housing 1 maintain a flat surface of a metal plate as is, and are formed with a forming process such as a punching process. As shown in FIG. 3(A), the terminals 8 include the upper arm portions 9; the middle arm portions 10; the lower arm portions 11; and connecting portions 12. The lower arm portions 11 extend from a rear side (right side in FIG. 3(A)) to a front side, and are inserted into the slits 5A formed in the middle wall portion 5 of the housing 1 in the direction. Projections 11A formed on the lower arm portions 11 as held portions bite into the slits 5A and are held with the slits 5A, thereby preventing pulling out. Supporting portions 11B with a projecting shape are formed at positions near inner edge free ends of the lower arm portions 11. The connecting portions 12 are disposed at rear sides of the lower arm portions 11, and extend toward outside of the housing 1. Lower edges of the connecting portions 12 are situated slightly below a lower surface of the housing 1, and are slightly inclined downwardly toward the rear side.

In the terminals 8, the upper arm portions 9 and the middle arm portions 10 extend toward the left side from positions at left sides of the flexible portions 13 curved and extending upwardly from base portions of the lower arm portions 11. The flexible portions 13 have narrow portions formed of recessed curved portions 13A at positions near the base portions of the connecting portion 12 for increasing flexibility.

The upper arm portions 9 and the middle arm portions 10 have a shape branched at a position on a left side of the flexible portions 13, and have free ends at positions substantially same as those of the free ends of the lower arm portions 11.

The upper arm portions 9 have step portions 9A in lower edges at the middle thereof, and are tapered toward the free ends thereof. A cam shaft portion 14 of the pressure potion 3 is retained between the upper arm portions 9 and the middle arm portions 10 at a range in front of the step portions 9A.

The middle arm portions 10 have an overall shape narrower than that of the upper arm portions 9, and have contacting portions 10A with a projecting shape at lower edge distal ends thereof. A portion from the contacting portion 10A to a position contacting with the cam shaft portion 14 of the pressing portion member 3 has a width larger than that of a portion to a base portion, thereby increasing rigidity.

The upper arm portions 9 and the middle arm portions 10 deform together around the flexible portions 13, and also have elasticity individually so as to deform in a direction separating from each other upon receiving an external force from the cam shaft portion 14 of the pressing portion member. At this time, since the middle arm portions 10 are narrower than the upper arm portions 9, so that the deformation thereof becomes greater by the amount.

Figure 3:
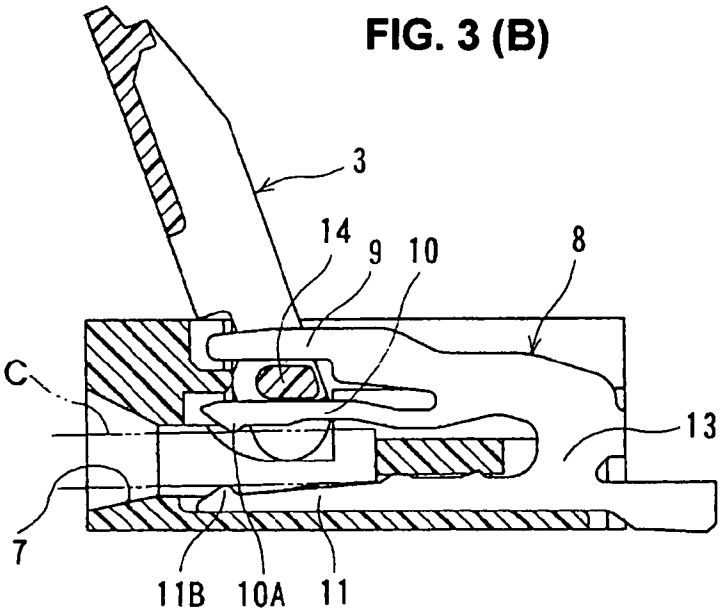
FIG. 3 are sectional views of the connector shown in FIG. 1 and FIG. 2, wherein (A) shows the state that the pressing portion member is in the open state and the cable is not inserted, (B) shows the state that the pressing portion member is in the open state and the cable is inserted, (C) shows the middle of rotation of the pressing portion member, and (D) shows the state that the pressing portion member is in the closed state.
Figure 3:
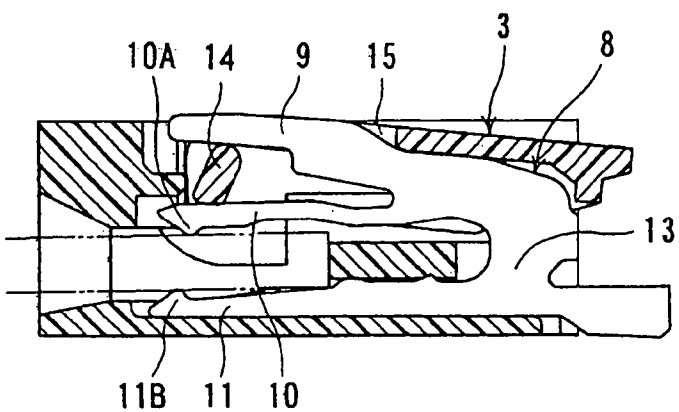
Figure 3:
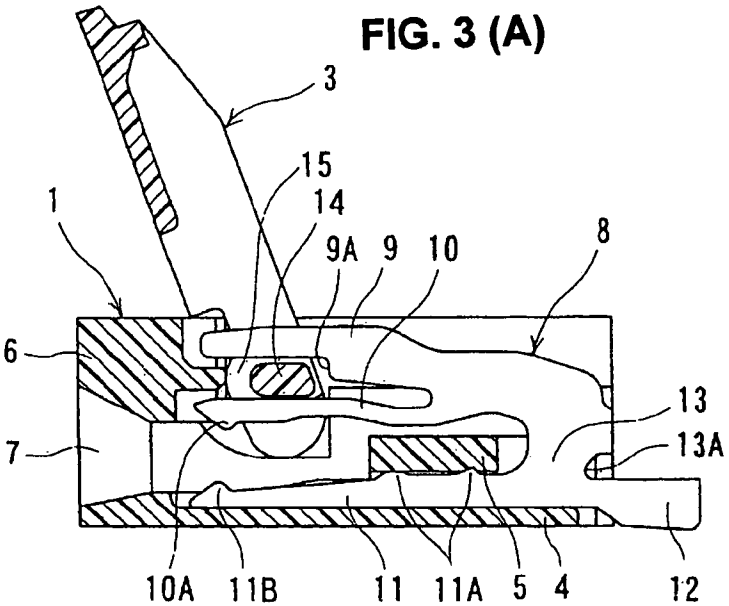
Figure 3:
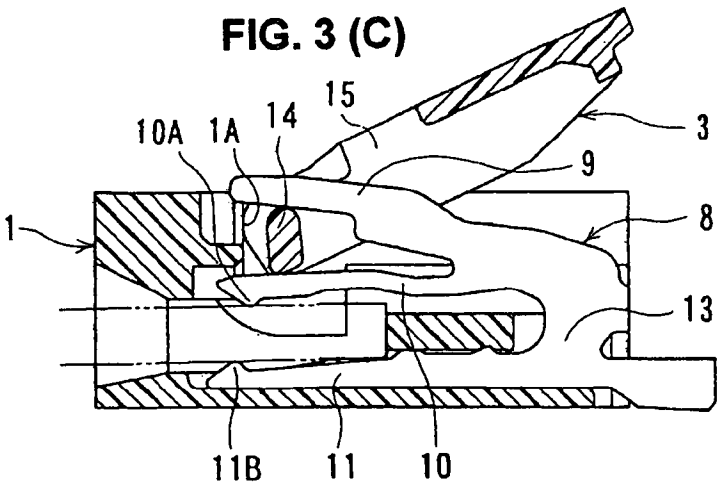

The pressing portion member 3 has a lid shape relative to the housing 1 as shown in FIG. 2, and has a lever shape in a sectional view shown in FIG. 3. The pressing portion member 3 is formed of an insulating material similar to the housing 1, and has the cam shaft portion 14 as shown in FIG. 3. The pressing portion member 3 rotates around the cam shaft portion 14, and is capable of moving between the open position shown in FIG. 3(A) and the closed position shown in FIG. 3(D).

The pressing portion member 3 is provided with groove portions 15 at positions corresponding to the terminals 8 in an area where the cam shaft portion 14 is located, that is, a lower half portion shown in FIG. 3(A), so that the distal ends of the upper arm portions 9 and the middle arm portions 10 of the terminals 8 can penetrate. The cam shaft portion 14 has a sectional shape such that the section is elongated laterally, that is, in a longitudinal direction of the upper arm portions 9 and the middle arm portions 10, when the pressing portion member 3 is located at the open position shown in FIG. 3(A); and the section is elongated vertically, that is, in a direction perpendicular to the longitudinal direction of the upper arm portions 9 and the middle arm portions 10, when the pressing portion member 3 is located at the closed position shown in FIG. 3(D). The cam shaft portion 14 has a short diameter smaller than a distance between the upper arm portion 9 and the middle arm portion 10 when they become a free state, and a long diameter larger than the distance.

A method of using the connector of the present embodiment having the configuration described above will be explained next with reference to FIG. 3.

(1) First, in FIG. 3(A), the pressing portion member 3 is in the open state and stands up. In this state, the cam shaft portion 14 of the pressing portion member 3 is in the laterally elongated state and does not apply a force to the upper arm portions 9 and the middle arm portions 10 of the terminals 8, so that the both arm portions 9 and 10 become a free state. Accordingly, the middle arm portions 10 are widely open relative to the lower arm portions 11.

(2) Next, a flat cable C is inserted through the insertion opening 7 formed in the front surface of the housing 1. The flat cable C is provided with, for example, a connecting portion (not shown) to be connected to the terminals in an upper surface of a front end thereof. As shown in FIG. 3(B), the flat cable C is inserted up to a specific position while the front end of the flat cable C abuts against an end surface of the middle wall portion 5. Accordingly, the flat cable C is inserted up to the specific position between the middle arm portions 10 and the lower arm portions 11 of the terminals 8.

(3) Then, the pressing portion member 3 rotates and moves to the closed position shown in FIG. 3(D) through a state shown in FIG. 3(C). At this time, the pressing portion member 3 is prevented from shifting in a backward direction from the abutting portion 1A of the housing 1. As shown in FIG. 3(C) and FIG. 3(D), when the pressing portion member is rotated, the cam shaft portion 14 thereof becomes the vertically elongated shape. Accordingly, the cam shaft portion 14 pushes the upper arm portions 9 of the terminals 8 upwardly, and pushes the middle arm portions 10 downwardly, so that they are deformed in the separating direction. As described above, the middle arm portions 10 deform more greatly than the upper arm portions 9. Further, the upper arm portions 9 and the middle arm portions 10 deform around the flexible portions 13 as a whole. Accordingly, the shift of the upper arm portions 9 and the middle arm portions 10 becomes an overlapped shift of the individual shift and the overall shift as a whole. The shift becomes a maximum value in the state shown in FIG. 3(C). When the pressing portion member moves completely at the closed position, the shift becomes a value slightly less than the maximum value. Accordingly, the pressing portion member 3 does not open inadvertently beyond the state shown in FIG. 3(C) even though the pressing portion member 3 receives an external force.

In the upper arm portions 9 and the middle arm portions 10, a downward restoration force is generated as a reaction force of the deformation around the flexible portions 13 accompanying with the upward shift of the upper arm portions 9. The force allows the middle arm portions 10 to shift together, thereby increasing a force pressing the flat cable C.

The middle arm portions 10 deforming downwardly sandwich the flat cable C in between with the lower arm portions 11, and contact with the corresponding contacting portion of the flat cable C with the contacting portions 10A thereof. As described above, the pressing portion member 3 has the groove portions 15 around the cam shaft portion 14 and opens. Accordingly, as shown in FIG. 3(D), when the pressing portion member 3 is located at the closed position, the upper edges of the upper arm portions 9 are retained in the groove portions 15, thereby allowing the upper arm portions 9 to shift upwardly and preventing the connector from increasing a size thereof in the height direction. The region near the free end of the middle arm portion, i.e., the region supporting the cam shaft from the contacting portion, has a width in the height direction larger than the middle portion connected to the base portion of the middle arm portion, thereby providing high rigidity.

In the present embodiment, the case that the flat cable has the contacting portion on the upper surface is explained as an example. When the connecting portion is provided on a lower surface or both upper and lower surfaces, the cable is applicable to the present embodiment. Relative to the connecting portion on the lower surface, the supporting portions 11B with a projecting shape of the lower arm portions 11 function as the contact portions of the terminals. This is true for other embodiments.

Second Embodiment

In the first embodiment shown in FIG. 1 to FIG. 3, the abutting portion 1A of the housing 1 regulates the pressing portion member 3, so that the rotational center is not shifted backwardly when the pressing portion member 3 rotates. In this embodiment, it is characterized that the cam shaft portion 14 as the rotational center is regulated in the terminals as well.

Figure 4:
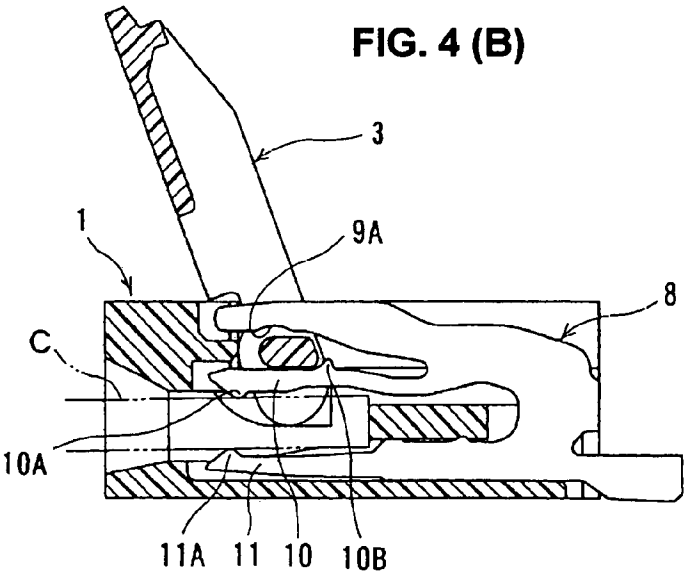
FIG. 4 are sectional views of the connector according to the second embodiment, wherein (A) to (D) correspond to (A) to (D) of FIG. 3.
Figure 4:
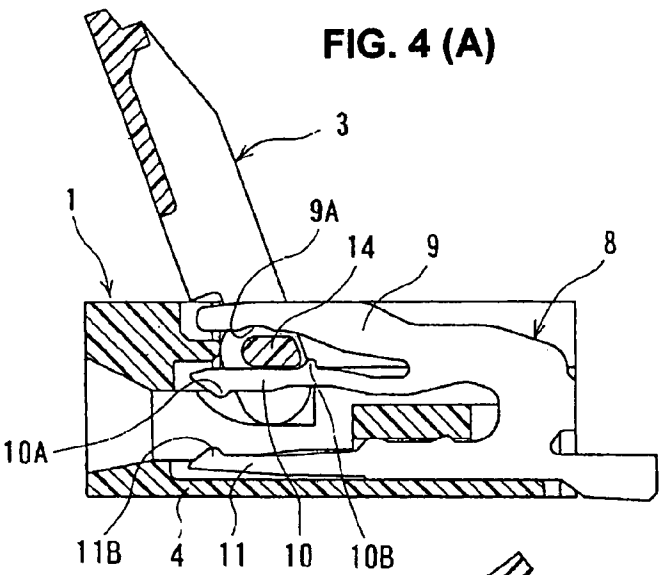
Figure 4:
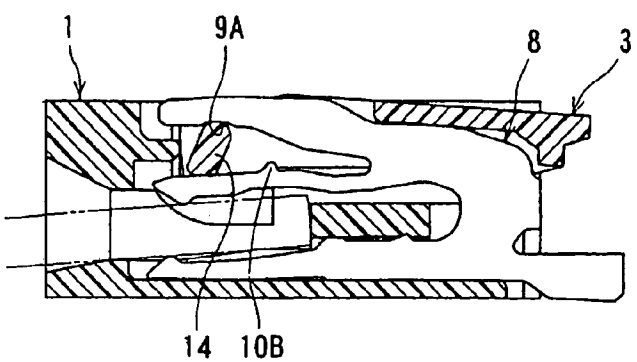
Figure 4:
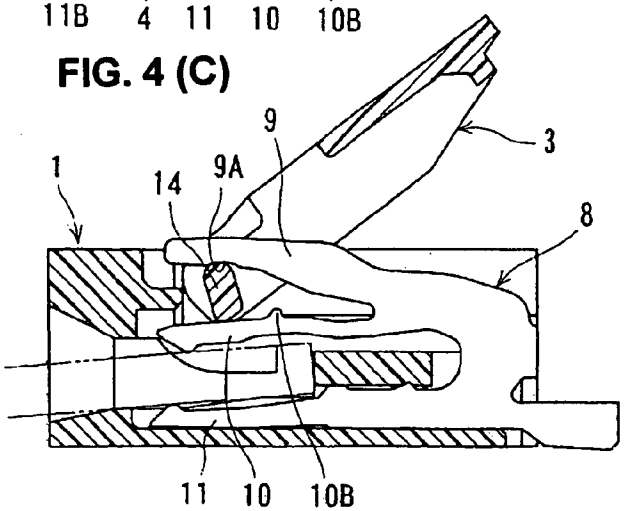

As shown in FIG. 4(A), in the present embodiment, the upper arm portions 9 of the terminals 3 are provided with recess portions 9A for guiding a rotation, and the middle arm portions 10 are provided with projections 10B, so that the recess portions 9A and the projections 10A function as a regulating portion. Accordingly, as shown in FIGS. 4(A) to (D), when the pressing portion member 3 moves from the open position to the closed position, the cam shaft portion 14 of the pressing portion member 3 is directly regulated from shifting backwardly with the recess portions 9A and the projections 10A.

Further, in the present embodiment, the lower edges of the lower arm portions 11 form gaps relative to the bottom wall portion 4 of the housing 1 in the front region thereof, thereby providing flexibility. Accordingly, the lower arm portions 11 are pushed by the flat cable C to be able to shift downwardly when the pressing portion member 3 moves to the closed position. Therefore, even though the positions of the contacting portions 10A or the supporting portions 11B of the plural terminals are varied, it is possible to absorb the variances.

Third Embodiment

Figure 5:
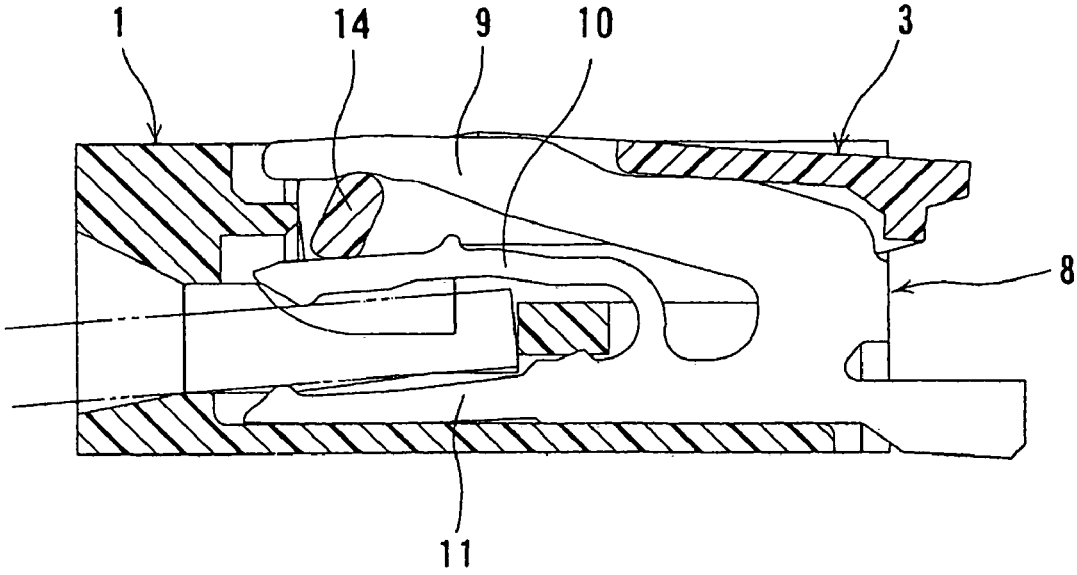
FIG. 5 is a sectional view of the connector according to the third embodiment.

In the first embodiment, the upper arm portions 9 and the middle arm portions 10 of the terminals 3 are branched via the region extending upwardly from the base portions of the lower arm portions 11. In the present embodiment shown in FIG. 5, not via the region, they are branched immediately from the base portions of the lower arm portions. In this case, when the cam shaft portion 14 rotates, the upper arm portions 9 and the middle arm portions 10 deform in the direction separating from each other, and the upper arm portions 9 try to return downwardly around the flexible portions 13, thereby obtaining the restoration force.

Fourth Embodiment

Figure 6:
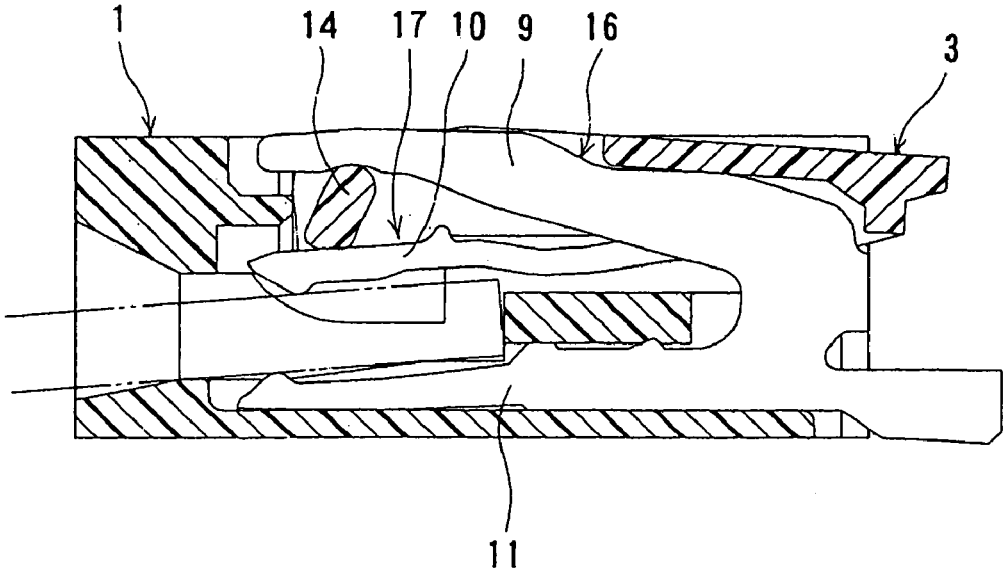
FIG. 6 is a sectional view of the connector according to the fourth embodiment.

In the embodiments described above, all of the terminals have the same shape. In the present embodiment, it is characterized that two types of terminals are provided. As shown in FIG. 6, first terminals 16 and second terminals 17 are provided, and both terminals 16 and 17 are arranged alternately. As compared with the terminals 8 of the previous embodiments, the first terminal 16 does not have the middle arm portion, and the second terminal 17 does not have the upper arm portion. In other words, the first terminals 16 have the upper arm portions 9 and the lower arm portions 11, and the second terminals 17 have the middle arm portions 10 and the lower arm portions 11. Accordingly, the cam shaft portion 14 of the pressing portion member 3 is rotationally supported and guided with the pair of the upper arm portions 9 of the first terminals 16 and the middle arm portions 10 of the second terminals 17.

The invention claimed is:

1. An electrical connector for a flat cable, comprising:

a plurality of metal terminals arranged in a housing such that plate surfaces thereof are parallel to each other, each of said metal terminals including an upper arm portion, a middle arm portion, and a lower arm portion each extending in a substantially same direction;

a cam portion of a pressing portion member supported and guided between the upper arm portion and the middle arm portion capable of elastically deforming in a plate surface so that the pressing portion member is movable between an open position and a closed position; and an insertion space between the middle arm portion and the lower arm portion for receiving the flat cable; wherein at least one of the middle arm portion and the lower arm portion has a contact portion at an inner edge portion thereof for contacting with a circuit portion of the flat cable; when the pressing portion member is located at the open position, the flat cable is being inserted into the insertion space; and when the pressing portion member is located at the closed position, the pressing portion member pushes the middle arm portion to deform in the plate surface of the terminal so that the flat cable is pressed and contacted with the contact portion; wherein said lower arm portion is provided with a held portion held with the housing at a base portion thereof; a flexible portion is provided at a base portion of the upper arm portion extending upwardly from the base portion of the lower arm portion; and when the pressing portion member moves to the closed position, the middle arm portion and the upper arm portion have elasticity to degenerate integral deformation around the flexible portion as well as deformation in a separating direction from each other relatively.

2. The electrical connector for a flat cable according to claim 1, wherein said middle arm portion has elasticity deforming easier than the upper arm portion.

3. The electrical connector for a flat cable according to claim 1, wherein said middle arm portion is formed to branch from the upper arm portion at a specific position away from the flexible portion.

4. The electrical connector for a flat cable according to claim 1, wherein said lower arm portion is attached to the housing through a corresponding slit of the housing, said held portion disposed at the base portion of the lower arm portion being held with the corresponding slit.

5. The electrical connector for a flat cable according to claim 1, wherein at least one of said upper arm portion and said middle arm portion is provided with a regulating portion having at least one of a concave shape and a convex shape for regulating a cam shaft portion of the pressing portion member to move within a specific range.

6. The electrical connector for a flat cable according to claim 1, wherein said middle arm portion includes an area including the flexible portion and a portion supporting the cam shaft portion of the pressing portion member having a rigidity greater than that of other area of the middle arm portion.

7. The electrical connector for a flat cable according to claim 1, wherein said housing includes an abutting portion entering between the terminals from free ends thereof and abutting against the pressing portion member at a portion other than the cam shaft portion of the pressing portion member for guiding and regulating the pressing portion member when the pressing portion member moves between the open position and the closed position.

8. The electrical connector for a flat cable according to claim 1, wherein said lower arm portion has a gap between a free end portion thereof and the housing to have elasticity.

9. The electrical connector for a flat cable according to claim 1, wherein said pressing portion member is opened upwardly near the cam shaft portion, said opening forming a space for allowing the upper arm portions of the terminals to deform upwardly.

10. An electrical connector for a flat cable, comprising:

a plurality of metal terminals arranged in a housing such that plate surfaces thereof are parallel to each other, each of said metal terminals including an upper arm portion, a middle arm portion, and a lower arm portion each extending in a substantially same direction;

a cam portion of a pressing portion member supported and guided between the upper arm portion and the middle arm portion to elastically deforming in a plate surface so that the pressing portion member is movable between an open position and a closed position; and an insertion space between the middle arm portion and the lower arm portion for receiving the flat cable; wherein at least one of the middle arm portion and the lower arm portion has a contact portion at an inner edge portion thereof for contacting with a circuit portion of the flat cable; when the pressing portion member is located at the open position, the flat cable is inserted into the insertion space; and when the pressing portion member is located at the closed position, the pressing portion member pushes the middle arm portion to deform in the plate surface of the terminal so that the flat cable is pressed and contacted with the contact portion; wherein said lower arm portion is provided with a held portion held with the housing in a range of a base portion thereof; an end portion of the base portion is provided with a connecting portion and a base portion of the upper arm portion extending upwardly from a portion between the held portion and the connecting portion; and when the pressing portion member completely moves to the closed position, the middle arm portion receives a resistance force from the flat cable to elastically deform the upper arm portion so that the flat cable is sandwiched between the upper arm portion and the lower arm portion through the pressing portion member and the middle arm portion.

11. The electrical connector for a flat cable according to claim 10, wherein said middle arm portion has elasticity deforming easier than the upper arm portion.

12. The electrical connector for a flat cable according to claim 10, wherein said middle arm portion is formed to branch from the upper arm portion at a specific position away from the flexible portion.

13. The electrical connector for a flat cable according to claim 10, wherein said lower arm portion is attached to the housing through a corresponding slit of the housing, said held portion disposed at the base portion of the lower arm portion being held with the corresponding slit.

14. The electrical connector for a flat cable according to claim 10, wherein at least one of said upper arm portion and said middle arm portion is provided with a regulating portion having at least one of a concave shape and a convex shape for regulating a cam shaft portion of the pressing portion member to move within a specific range.

15. The electrical connector for a flat cable according to claim 10, wherein said middle arm portion includes an area including the flexible portion and a portion supporting the cam shaft portion of the pressing portion member having a rigidity greater than that of other area of the middle arm portion.

16. The electrical connector for a flat cable according to claim 10, wherein said housing includes an abutting portion entering between the terminals from free ends thereof and abutting against the pressing portion member at a portion other than the cam shaft portion of the pressing portion member for guiding and regulating the pressing portion member when the pressing portion member moves between the open position and the closed position.

17. The electrical connector for a flat cable according to claim 10, wherein said pressing portion member is opened upwardly near the cam shaft portion, said opening forming a space for allowing the upper arm portions of the terminals to deform upwardly.

18. The electrical connector for a flat cable according to claim 4, wherein said lower arm portion has a gap between a free end portion thereof and the housing to have elasticity.

19. An electrical connector for a flat cable, comprising:

a plurality of metal terminals arranged in a housing such that plate surfaces thereof are parallel to each other, each of said metal terminals including three arm portions of an upper arm portion, a middle arm portion, and a lower arm portion each extending in a substantially same direction in an arranged state;

a cam portion of a pressing portion member supported and guided between the upper arm portion and the middle arm portion to elastically deform in a plate surface so that the pressing portion member is movable between an open position and a closed position; and an insertion space between the middle arm portion and the lower arm portion for receiving the flat cable; wherein at least one of the middle arm portion and the lower arm portion has a contact portion at an inner edge portion thereof for contacting with a circuit portion of the flat cable; when the pressing portion member is located at the open position, the flat cable is inserted into the insertion space; and when the pressing portion member is located at the closed position, the pressing portion member pushes the middle arm portion to deform in the plate surface of the terminal so that the flat cable is pressed and contacted with the contact portion; wherein said terminals include a plurality of sets of a first terminal and a second terminal; each of the first terminals has the upper arm portion and the lower arm portion; each of the second terminals has the middle arm portion and the lower arm portion and is combined with the first terminal, thereby forming the three arm portions; the lower arm portion has a held portion to be held with the housing at a base portion thereof; the first terminal has a flexible portion at a base portion of the upper arm portion extending upwardly form the base portion of the lower arm portion; the second terminal has a flexible portion at a base portion of the middle arm portion extending upwardly from the base portion of the lower arm portion; and when the pressing portion member moves to the closed position, the upper arm portion of the first terminal and the middle arm portion of the second terminal have elasticity to degenerate deformation around the flexible portion in a separating direction from each other relatively.

20. The electrical connector for a flat cable according to claim 19, wherein said pressing portion member is opened upwardly near the cam shaft portion, said opening forming a space for allowing the upper arm portions of the terminals to deform upwardly.

* * * * *